US006008575A

United States Patent [19]

Kaftanov et al.

[11] Patent Number: 6,008,575

[45] **Date of Patent: *Dec. 28, 1999**

[54] LIGHT SOURCE INCLUDING A FIELD EMISSION CATHODE, AND A FIELD EMISSION CATHODE

[75] Inventors: Vitaly Sergeevich Kaftanov; Alexander Leonidovich Suvorov; Evgenij Pavlovich Sheshin, all of Moscow, Russian Federation; Jan Olsfors, Le Vaud, Switzerland

[73] Assignee: LightLab AB, Stockholm, Sweden

[ * ] Notice: This patent is subject to a terminal disclaimer.

[21] Appl. No.: 08/904,622

[22] Filed: Aug. 1, 1997

[30] Foreign Application Priority Data

Jun. 13, 1997 [SE] Sweden ..... 9702275

[51] Int. Cl.[6] ..... H01J 1/30; H01J 19/24

[52] U.S. Cl. ..... 313/484; 313/491; 313/632; 313/309; 445/51

[58] Field of Search ..... 313/306, 309, 313/336, 346 R, 351, 484, 495–97, 491–93, 631–32, 634–35; 378/122; 445/49, 50–51; 315/169.1, 169.4

[56] References Cited

U.S. PATENT DOCUMENTS

| | | | |
|---|---|---|---|
| 4,272,699 | 6/1981 | Faubel et al. . | |
| 5,588,893 | 12/1996 | Kaftanov et al. . | |
| 5,603,649 | 2/1997 | Kaftanov et al. | 445/24 |
| 5,729,583 | 3/1998 | Tang et al. | 378/122 |
| 5,764,004 | 6/1998 | Rabinowitz | 313/346 R |
| 5,877,588 | 3/1999 | Kaftanov et al. | 313/309 X |

FOREIGN PATENT DOCUMENTS

| | | |
|---|---|---|
| 3338916 | 5/1985 | Germany . |
| 40 02 049 | 7/1991 | Germany . |
| 2 070 849 | 9/1981 | United Kingdom . |
| 2 089 561 | 6/1982 | United Kingdom . |
| 2 097 181 | 10/1982 | United Kingdom . |
| 2 126 006 | 3/1984 | United Kingdom . |
| WO96/25753 | 8/1996 | WIPO . |
| WO9707531 | 2/1997 | WIPO . |

*Primary Examiner*—Nimeshkumar D. Patel
*Assistant Examiner*—Mack Haynes
*Attorney, Agent, or Firm*—Jacobson, Price, Holman & Stern, PLLC

[57] ABSTRACT

A field emission cathode has particular use in a light source. The light source includes an evacuated container having walls, at least a portion of which consists of an outer glass layer which on at least a major part thereof is coated on the inside with a layer of phosphor forming a luminescent layer and a conductive layer forming an anode. The layer of phosphor is excited to luminescence by electron bombardment from a field emission cathode located in the interior of the container. A modulator electrode is arranged between the cathode and the anode for creating an electrical field necessary for the emission of electrons. The field emission cathode, includes a base body, and field emitting bodies extending from the base body. The base body includes a longitudinally extending core having a central axis. The field emitting bodies are elongate and are distributed along at least a part of the length of the core, extend radially outwards from the core, and have free ends provided with field emitting surfaces.

16 Claims, 3 Drawing Sheets

LIGHT SOURCE INCLUDING A FIELD EMISSION CATHODE, AND A FIELD EMISSION CATHODE

FIELD OF THE INVENTION

The present invention relates to a light source comprising an evacuated container having walls, at least a portion of which consists of an outer glass layer which on at least a major part thereof is coated on the inside with a layer of phosphor forming a luminescent layer and a conductive layer forming an anode, which layer of phosphor is excited to luminescence by electron bombardment from a field emission cathode located in the interior of the container, a modulator electrode being arranged between the cathode and the anode for creating an electrical field necessary for the emission of electrons, especially a light source for illumination.

Further, the present invention relates to a field emission cathode for use in a light source, for illumination purposes, including a base body, and field emitting bodies extending from the base body.

BACKGROUND OF THE INVENTION

Creating light has always fascinated man. Great efforts have been made to develop and improve different light sources.

One interesting type of light sources is the fluorescent tube. It has many advantages, but suffers from serious drawbacks. For example, there is always a delay after the power has been turned on until it starts to operate giving full light. It needs complicated control equipment, which requires space. To obtain light with a source of this kind it is unfortunately necessary to use materials having negative environmental effects.

Cathodoluminescent light sources is also an interesting type of light sources. Such light sources, including an evacuated envelope containing a grid and a heated cathode, for emission of electrons, are known from GB, A, 2 070 849 (The General Electric Company Limited), GB, A, 2 097 181 (The General Electric Company PLC), GB, A, 2 126 006 (The General Electric Company plc) and GB, A, 2 089 561 (The General Electric Company Limited). The insides of the envelopes are covered with a layer of phosphor of an electron-responsive type. These cathodoluminescent lamps have essentially the form of an electric bulb.

Since these light sources all have a heated cathode, the cathode has to be heated by special means, before the emission of light starts.

The use of electrons exciting phosphor to luminescence has the effect that more heat is produced than in comparable fluorescent tubes. It is therefore advantageous if the active surface, for the emission of light and for the necessary heat dissipation, is large. The cathodoluminescent lamps shown in the documents mentioned do not have optimal surfaces.

A light source of the kind mentioned in the first paragraph above is disclosed in U.S. Pat. No. 5,588,893 (Kentucky Research and Investment Company Limited). A field emission cathode is arranged inside an evacuated glass container having a luminescent layer arranged on its inner surface. A modulator is provided between the cathode and the luminescent layer. The cathode includes carbon fibers, arranged in bundles, preferably in a matrix, on a substrate. This light source is considered to be the prior art closest to the invention concerning a light source. The content of U.S. Pat. No. 5,588,893 is incorporated herein by reference.

However in the last-mentioned known light source, electrons are emitted only in a direction perpendicular to the substrate. Also there is no indication in the document how to produce the light source in a cost-efficient way.

The above mentioned U.S. Pat. No. 5,588,893 (Kentucky Research and Investment Company Limited) also discloses a field emission cathode of the kind mentioned above. The cathode disclosed includes carbon fibers, arranged in bundles, preferably in a matrix, on a substrate. The document also discloses a method including treatment of the emitting surfaces in order to achieve a cathode with higher efficiency than previous cathodes. This cathode is considered to be the prior art closest to the invention concerning a cathode.

Further, DE, C2, 40 02 049 (Deutsche Forschnungsanstalt fur Luft- und Raumfahrt e.V.) discloses an electron emitting source including a cathode which comprises small, felted or fabric plates, spaced apart from each other. The plates can consist of felted carbon fibers, and be arranged on a cylindrical cathode body The use is for irradiating a medium with electrons.

U.S. Pat. No. 4,272,699 (Max-Planck-Gesellschaft zur Forderung der Wissenschaften e.V.) discloses a field emission cathode in an electron impact ion source for an instrument such as a mass spectrometer or molecular beam detector. The cathode has angular configuration, and includes bundles of carbon fibers, with their emitting surfaces directed inwards.

Previously known field emission cathodes are often of a complicated and fragile construction, especially as concerns the mountings and the attachment of field emitting bodies.

It has been found in connection with cathodes including fibers that the electrical fields acting between the cathode and a grid or an anode will cause individual fibers to get loose from their carrier if they are not safely secured thereto. Once loose, the fibers will, in most cases, be attracted by the grid and cause a short circuit between the cathode and the grid, until it burns oft after some time due to the resulting current through the fiber.

SUMMARY OF THE INVENTION

It is an object of the invention to provide a light source and a field emission cathode, respectively, having a long life, with high efficiency and stability, which can be produced at low cost.

These and other objects are attained by the features set forth in the appended claims.

By the features in claim 1, further, a light source without a starting up period is achieved, i.e. when the power is turned on, the light starts immediately, thanks to the use of a field emission cathode. A light source with no need for materials having negative environmental effects is also achieved.

By the features in claim 1, further, a light source having a field emitting cathode of simple and robust construction is obtained.

By the features in claim 2, further, a light source having a large active light emitting surface is achieved. This efficient use of the surface renders it possible to achieve a light source having a high light emission in relation to the heat produced.

By the features in claim 3, further, a light source having a high and uniform light emission is achieved.

By the features in claim 4, further, a light source having an improved light emission is achieved.

By the features in claim 5, further, a light source operating at lower voltages is achieved.

By the features in claims 6 through 11, further, a light source having a high and uniform light emission is achieved.

By the features in claim 12, further, a field emitting cathode of simple and robust construction is obtained.

By the features in claims 13 through 16, a field emitting cathode is obtained which further provides for a high emission and uniform distribution of emitted electrons, in particular through a cylindrical surface region surrounding the cathode. A cathode with less interference between the field emitting surfaces is also achieved.

By the features in claims 15 or 16, a field emitting cathode is achieved, which further provides for a more stable emission of electrons minimizing the risk of fibers getting loose and adversely affect the operation. Through the arrangements in claims 15 or 16, the forces acting upon each fiber due to the electrical fields are essentially equal on each of the two parts of the fibers extending from the core.

DESCRIPTION OF THE PREFERRED EMBODIMENT

Figures 1, 2, 3, 4, 5, 6:
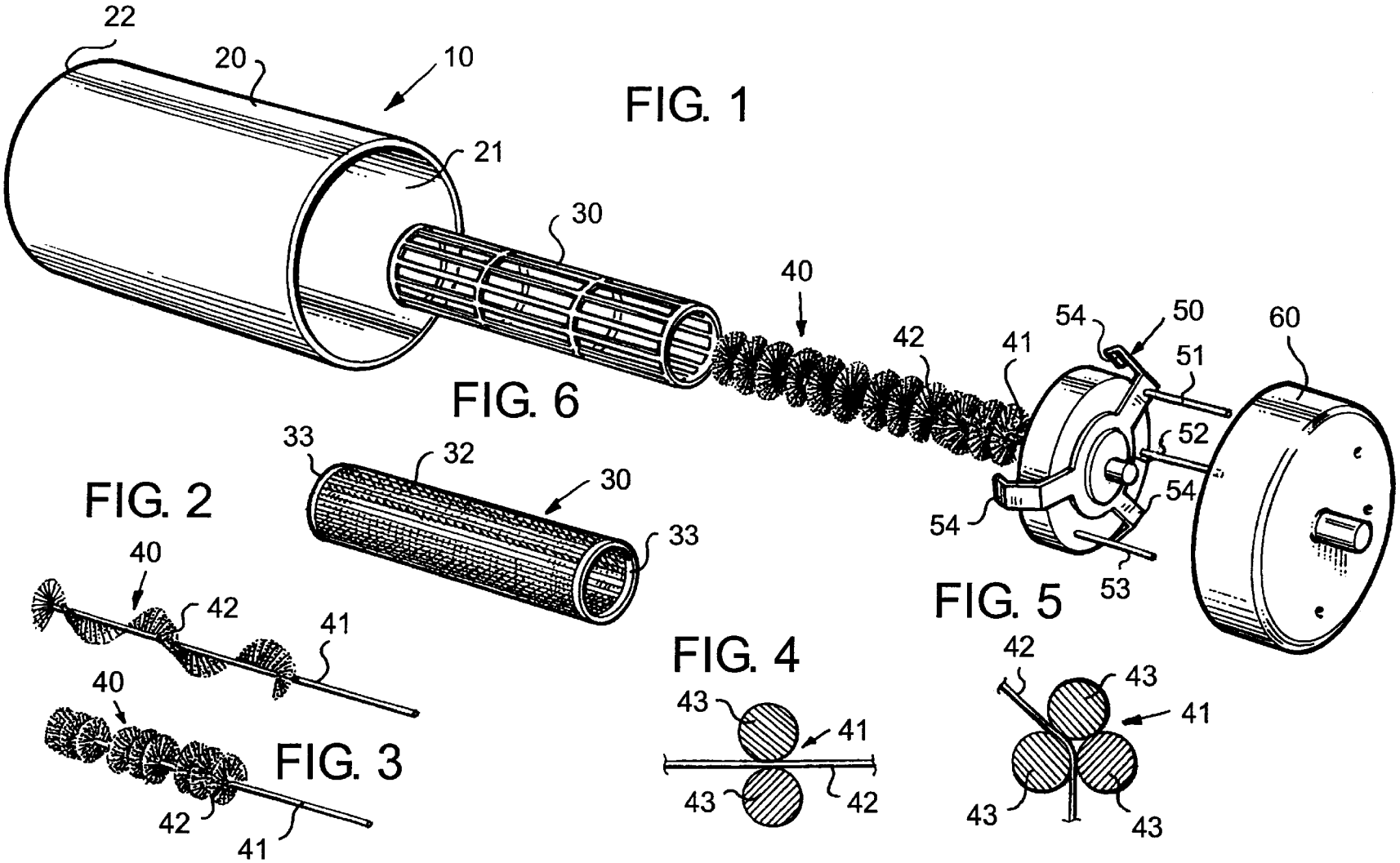
FIG. 1 is an exploded view of an embodiment of a light source according to the present invention.
FIG. 2 is a view of an embodiment of a cathode according to the present invention.
FIG. 3 is a view of an alternative embodiment of a cathode according to the present invention.
FIG. 4 is a cross section of a cathode according to the invention.
FIG. 5 is a cross section of an alternative cathode according to the invention.
FIG. 6 is a view of a modulator electrode or grid.

Referring to FIG. 1, there is shown, in an exploded view an embodiment of a light source according to the present invention, identified generally by the numeral 10, and especially intended for illumination purposes. It includes a container having walls, one of which is identified by the numeral 20. This wall 20 has an outer glass layer and is shown to be cylindrical. The cylinder 20 has an open end 21 which is covered by an end cap 60. A sealing (not shown) is provided between the end cap and the cylinder 20, in order to achieve an air-tight sealing of the container. At the other end 22 of the cylinder 20 there can be arranged a circular wall as a continuation of the cylinder wall 20, also having an outer layer of glass. Alternatively, the end 22 can be open and provided with an end cap similar to the one arranged at the end 21, also provided with a sealing. The container is sealed in order to maintain the vacuum created when the container is evacuated.

Inside the container, a modulator electrode or grid 30 is arranged. It is preferably cylindrical and arranged coaxially with the container wall 20. The construction and the function of this modulator electrode or grid 30 will be explained further below.

Inside the modulator electrode or grid and preferably coaxially therewith, a cathode 40 is arranged. This cathode is a cold cathode, especially a field emission cathode. Its construction and function will be explained further below.

The light source also includes a fitting 50 provided with electrical connections 51–54. The fitting 50 further includes means (not shown) for fastening of the cathode 40 and the modulator electrode or grid 30. Those can be soldered to the sitting 50 or they can be adhered to the fitting 50 by an adhesive, preferably an electrically conducting adhesive. They could also be clamped to the fitting 50 by a clamping means or gripped by a gripping means. Electrical connection means (not shown) are also provided on the fitting for connecting the cathode 40 and the modulator electrode or grid 30, respectively. Those connection means are provided with conductive terminal pins 52, 53 which extend through the fitting and are insulated from each other. A further terminal pin 51 is connected to a conductive means provided with conductive fingers or similar 54, which in the assembled state of the light source are in contact with a conductive layer 25 provided inside the container, which will be further described below. The terminal pins 51–53 all extend through the end cap, which is provided with openings therefor. The terminal pins 51–53 are electrically insulated from each other, and the corresponding openings in the end cap 60 are air-tight sealed. At the other end 22 of the container wall 20, there can be arranged a fitting similar to the fitting 50, to support the cathode 40 and the modulator electrode or grid 30. However, this fitting, at the other end 22, could be formed without electrical connection means. An end cap similar to the end cap 60 arranged at the end 21, also provided with a sealing, is preferably arranged to cover the fitting at the other end 22. Of course, if the fitting is not provided with electrical connection means, the corresponding end cap should not be provided with feed-through openings. As an alternative to arranging a fitting, which supports the cathode 40 and the modulator electrode or grid 30 at the other end 22, an end cap similar to the end cap 60 can itself be provided with supporting, fastening or gripping means for the cathode 40 and the modulator electrode or grid 30. It is also possible that a circular wall, which is a continuation of the cylinder wall 20, is provided with supporting, fastening or gripping means. A further alternative is that the cathode 40 and the modulator electrode or grid 30 are self-supporting and fastened in such a way to the fitting 50 that there is no need for a support or fastening means at the other end.

One embodiment of a cathode 40 is shown in FIG. 1. However, the cathode can be formed in various other ways, two of which are shown in FIGS. 2 and 3. The cathodes shown in FIGS. 1, 2 and 3 all include a longitudinally extending core having a central axis, and field emitting bodies 42 extending from the core. The field emitting bodies 42 are elongate and are distributed along at least a part of the length of the core 40. In the embodiments shown, the field emitting bodies 42 are fibers which extend radially outwards from the core and have free ends provided with field emitting surfaces. Preferably, the fibers are commercially available polyacrylziitrile carbon fibers, or other suited material containing carbon, and having a diameter in the range of a few microns ($\mu$m). By the use of carbon fibers it is sufficient with a moderate vacuum in the container. The fibers have irregularities at the field euitting surfaces, and to improve the field emission capacity, the field emitting surfaces will undergo a treatment, before the assembling of the cathode. This treatment includes the steps of modifying said field emitting surfaces by applying to said fibers a variable electric field, in order to induce electron field emission from said emitting surfaces, and increasing said variable electric field, in such a manner that a deterioration of said irregularities of said field emitting surfaces is limited.

In FIG. 4, which is a cross section of a cathode according to the invention, it is illustrated that the core can consist of two wires 43. It is shown how one of the fibers 42 is secured between the two wires of the core. Along the core, thousands or hundreds of fibers are secured between the wires. To secure the fibers even better to the core, an adhesive acting between the core and the fibers may he used. The adhesive used is preferably electrically conductive. Alternatively, if the wires 43 are twisted, the resulting clamping force between the wires 43 will safely secure the fibers 42 to the core 41. If the wires are twisted, the fibers 42 will extend from the core in a helical pattern.

In another embodiment, shown in FIG. 5, the core 41 consists of three wires. Each fiber 42 is bent in a curve around one of the wires. The wires 43 are preferably twisted and the resulting clamping force will secure the fiber in a favorable manner through the bending of the fiber. Even when the core is formed by two or more twisted wires, an adhesive may be used. The wires 43 are made of an electrically conducting material e.g. copper, steel or other suited material, and preferably with a diameter sufficient for the core to remain in the twisted state after the twisting operation without any external force acting on the core. The fibers 42 are preferably secured to the core at their central portions so that the length of each fiber extending from the core is essentially equal on each side. The fibers preferably have essentially the same length. As seen in FIGS. 1–3, the fibers 42 of the cathodes extend from the respective core in a helical pattern. In FIGS. 1 and 2, this pattern is continuous, but the pitches of the helixes are different. In the cathode illustrated in FIG. 3, the helical pattern is interrupted so as to loave regions of the core without any fibers. Further, by choosing the pitch of the twisted wires, the distribution and the uniformity of the fibers, and thereby the field emitting surfaces, can be controlled.

The modulator electrode or grid 30 can be formed in various ways, whereof a first one is illustrated in FIG. 1 and a second one is illustrated in FIG. 6. However, it is preferred that the modulator electrode is cylindrical in order to achieve essentially the same distance between the modulator electrode and the field emitting surfaces of the fibers. The modulator electrode shown in FIG. 1 is a cage-like electrode having an essentially cylindrical form. The modulator electrode shown in FIG. 6 is preferably of metal wire-mesh supported by two rings, preferably of metal, one at each end. As understood by a person skilled in the art, there are many other ways to form the modulator electrode. For example, the modulator electrode can be supported by two insulating bodies, each in the form of a ring or a plate having a disc-like shape and being attached to the core of the cathode, or to the fitting 50, or to other fittings, or to an end cap. Between the insulating bodies, and in parallel to the core of the cathode, metal wires can be arranged so as to be distributed around the circumference of the rings or the disc-shaped plates. The wires are connected to each other at the region of the rings or disc-shaped plates. The material of the modulator electrode can be any suitable electrically conductive material that is used for manufacturing grids.

Figure 7:
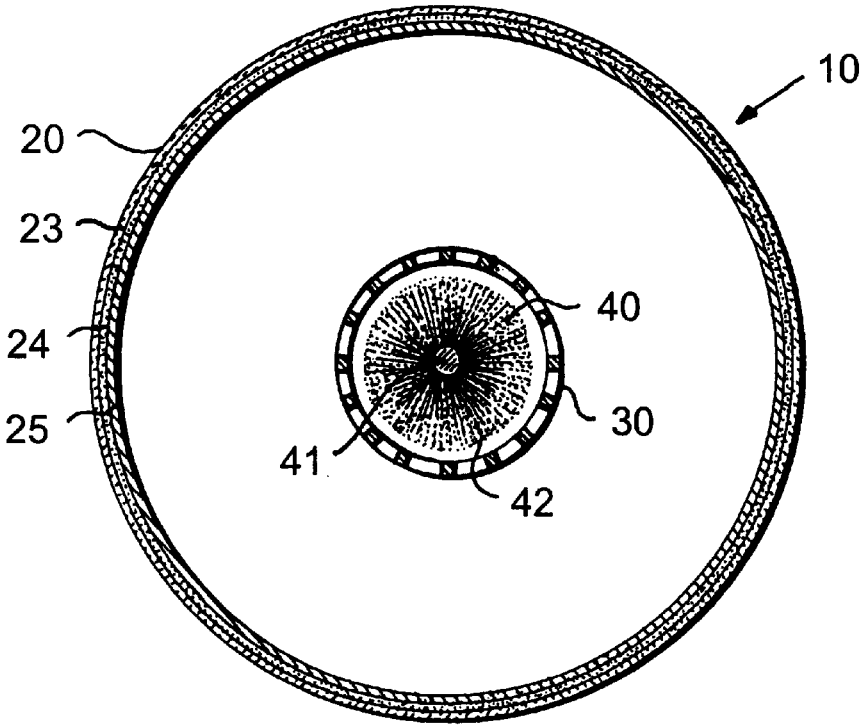
FIG. 7 shows a light source, according to the invention, in cross section.

FIG. 7 shows the light source in assembled state in cross section. As illustrated, the field emitting cathode 40 with its core 41 is placed in the center. The fibers extend radially outwards from the core in different directions exhibiting field emitting surfaces at their ends. The modulator electrode or grid 30 surrounds the cathode, with a distance between the field emitting surfaces of the fibers and the modulator electrode. This distance depends on the voltages to be supplied to the components and on the structure and composition of the field emitting bodies and their field emitting surfaces. However, the distance should be in the range of millimeters, for example 0.5–2 mm. To provide for a stable operation, the fibers are preferably of equal length, and the diameter of the cathode should be in the range of some millimeters up to a centimeter or more. For example, the diameter of a cathode may be 6–8 mm.

The cylindrical part 20 of the container walls surrounds the caythode 40 and the modulator electrode or grid 30. The cylindrical wall 20 consists of an outer glass layer 23, a phosphor layer 24 (a cathodoluminescent phosphor) and an inner conductive layer 25 forming an anode. The phosphor layer is a luminescent layer which upon electron bombardment emits visible light. The anode is preferably made of a reflecting, electrically conductive material, e.g. aluminum. The conductive fingers 54 are preferably in direct electrical contact with the anode 25. By arranging an aluminum layer covering the phosphor layer, adverse effects on the vacuum by possible evaporation of the phosphor are avoided.

In operation, a first voltage is supplied between the cathode 40 and the modulator electrode or grid 30, and a second voltage is applied between the cathode 40 and the anode 25. The second voltage is higher than the first voltage. The voltages are supplied from a feed and control circuit (noc shown), which could be located in a housing, connected to the mains e.g. through an ordinary lamp socket. The feed and control circuit supplies the voltages to the conductive terminal pins 51–53, to which it is connected. When the voltages are applied, an electrical field is created between the cathode 40 and the modulator electrode or grid 30. This field should be of sufficient strength to cause field emission of electrons from the field emitting surfaces of the field emitting cathode 40. The electrons will accelerate and pass through the holes or openings of the modulator electrode or grid 30 and further on towards the anode 25. This movement of the electrons towards the anode 25 is caused by the kinetic energy of the electrons when they leave the region of the modulator electrode or grid 30, and by the electrical field present between the modulator electrode or grid 30 and the anode 25. Since the electrons have high kinetic energy and the anode layer is relatively thin (order of magnitude microns ($\mu$m)), they will pass through the anode so as to enter the phosphor layer while still having sufficient kinetic energy to excite the phosphor to luminescence, whereby visible light is emitted. The electrons will then return to the anode to be drained off. The electron bombardment will cause, besides light, heating of the cylinder wall 20. The glass layer will provide for the dissipation of the heat. The voltages applied depend on the materials used, the structures of the cathode, and the modulator electrode or grid 30. The voltages are in the range of kV where the first voltage is a few kV, e.g., 1.5 kV, and the second voltage some kV, typically about 4–6 kV. The second voltage much depends on the type of phosphor used. New types of phosphor are continuously developed and because of that, the voltage must be adapted to the specific type of phosphor used. Changing the type of phosphor and thereby the voltages will cause changes in the currents and the heating of the cylinder wall.

Figure 8:
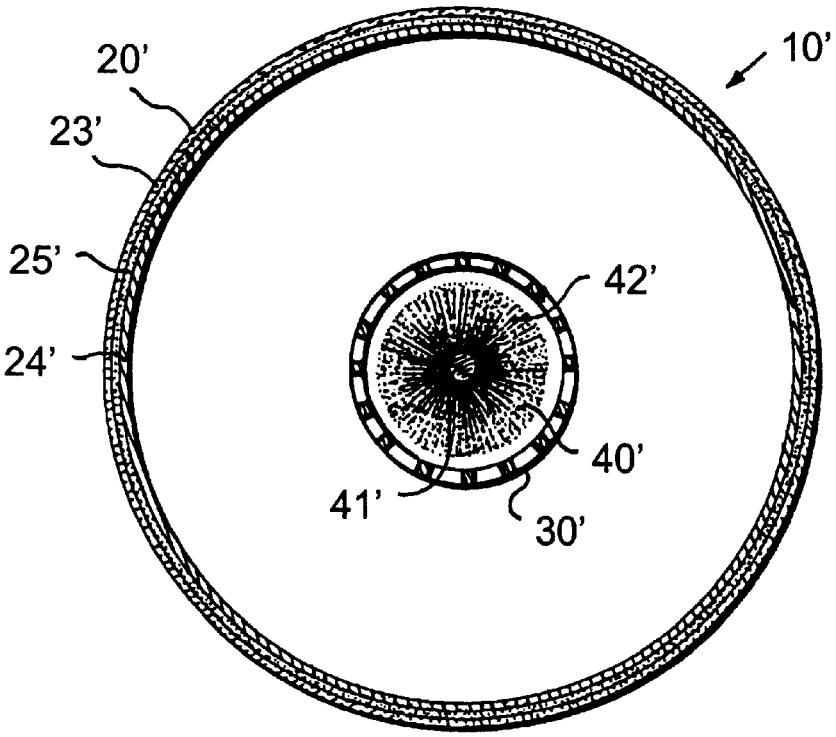
FIG. 8 shows an alternative light source, according to the invention, in cross section.

FIG. 8 shows an alternative embodiment of a light source, according to the invention, in assembled state and in cross section. The cathode 40' and the modulator electrode 30' are essentially the same as in FIG. 7. What differs from FIG. 7 is the arrangement of the layers of the wall 20'. It includes an outer glass layer 23', which is covered, on at least a major part of its inside, by an electrically conductive transparent material forming the anode 25'. The anode 25' then carries the phosphor layer 24' on the inside. The anode is made from e.g. tin oxide or indium oxide. To make it possible for the conductive fingers 54 to establish direct electrical contact with the anode 25', some regions of the anode 25' are not covered with phosphor. Alternatively, electrically conductive surfaces being in contact with the anode can be applied on to the phosphor layer. Those surfaces are small not to interfere with the operation of the light source but of sufficient size to establish electrical contact with the conductive fingers 54.

The operation of this embodiment illustrated in FIG. 8 is essentially the same as that of the embodiment illustrated in FIG. 7. However, after leaving the region of the modulator electrode or grid 30', the electrons will first hit the phosphor layer and excite it to luminescence, and thereafter they will be drained off by the anode. Since the electrons first hit the phosphor layer and do not have to pass through the anode layer before they hit the phosphor layer, the voltage applied between the cathode and the anode can be about 1–2 kV lower than in the embodiment illustrated in FIG. 7.

Figure 9:
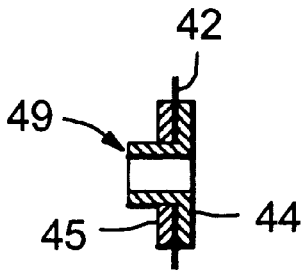
FIG. 9 shows, in cross section, a cathode element of a further embodiment of a cathode, according to the invention.
Figure 10:
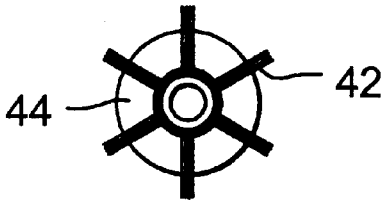
FIG. 10 is a view of a part of the cathode element shown in FIG. 9.
Figure 11:
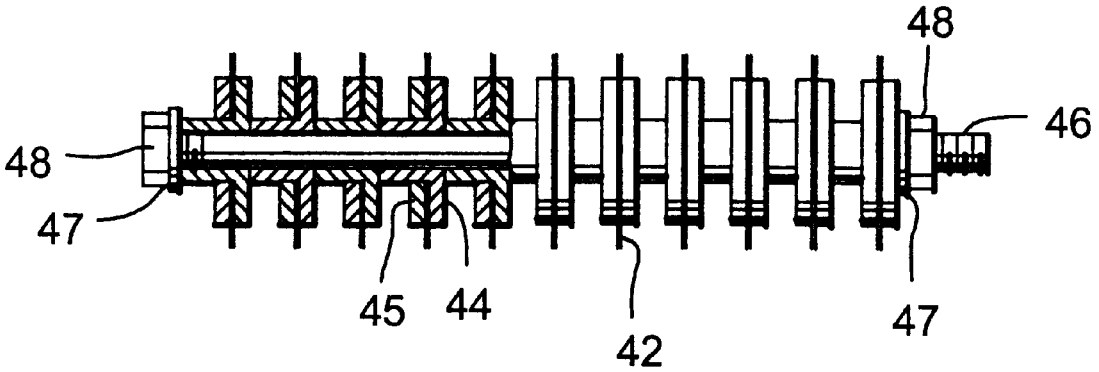
FIG. 11 shows, in a side view, partially in a longitudinal section, a cathode of the further embodiment according to the invention, including cathode elements shown in FIG. 9.

FIGS. 9–11 illustrate a third embodiment of a cathode. This cathode is formed by a longitudinal row of cathode elements 49. As seen in FIG. 9, each cathode element consists of a pair of annular discs 44, 45, wherein one disc 44 is provided with a central, axial tubular extension formed to support the other annular disc 45 at its central opening. Between the annular discs, fibers 42 are attached. Preferably, the fibers 42 are clamped between the two annular discs in each pair, and the annular disc 45 is held in position by a frictional grip with the tubular extension of the adjacent annular disc 44. The fibers can alternatively be secured by an adhesive acting between the fibers and either one of the discs, or both. In FIG. 10, it is shown how the fibers 41 are placed in relation to annular disc 44. The cathode elements are stacked on to a rod 46, and secured thereto by means of a washer 47 and a nut 48 at each end of the rod, or by any other suitable means. The rod 46 and the annular discs are preferably made of an electrically conducting material. The rod can for example be made of steel. If an adhesive is used, it is preferred that it is electrically conductive.

Although the invention is described by means of the above examples, naturally, a skilled person would appreciate that many other variations than those explicitly disclosed are possible within the scope of the claims.

It should be noted that although the embodiments include certain details for the electrical connection and for the support of the parts in the light source, those can be formed in many other ways, as appreciated by a person skilled in the art, and do not limit the scope of invention.

We claim:

1. A light source, comprising an evacuated container having walls, at least a portion of which consists of an outer glass layer which on at least a major part thereof is coated on the inside with a layer of phosphor forming a luminescent layer and a conductive layer forming an anode, which layer of phosphor is excited to luminescence by electron bombardment from a field emission cathode located in an interior of the container, a modulator electrode being arranged between the cathode and the anode for creating an electrical field necessary for the emission of electrons, wherein:

the field emission cathode includes a longitudinally extending core having a central axis, and field emitting bodies extending from the core, the field emitting bodies are elongate and are distributed along at least a part of the length of the core, and the field emitting bodies extend radially outwards from the core and have free ends provided with field emitting surfaces.

2. The light source according to claim 1, wherein the container has a cylindrical shape.

3. The light source according to claim 2, wherein the modulator electrode includes a conductive, substantially cylindrical structure surrounding the field emission cathode.

4. The light source according to claim 3, wherein the luminescent layer is arranged between the glass layer and the anode, and the anode is made of a reflective material for reflection of the light emitted from the luminescent layer.

5. The light source according to claim 3, wherein the anode is arranged between the glass layer and the luminescent layer, and the anode is made of a transparent material.

6. The light source according to claim 3, wherein said field emitting bodies extend radially outwards from the core in different directions.

7. The light source according to claim 6, wherein the field emitting surfaces are essentially uniformly distributed around the core.

8. The light source according to claim 7 wherein the field emitting bodies have essentially the same length.

9. The light source according to claim 8 wherein the field emission cathode has an essentially cylindrical outer shape, defined by the field emitting surfaces.

10. The light source according to claim 9 wherein the field emitting bodies are of carbon.

11. The light source according to claim 10, wherein said field emitting bodies, having irregularities at said field emitting surfaces, are treated by modifying said field emitting surfaces by applying to said field emitting bodies a variable electric field, in order to induce electron field emission from said emitting surfaces, and increasing said variable electric field, in such a manner that a deterioration of said irregularities of said field emitting surfaces is limited.

12. The field emission cathode, for use in a light source, for illumination purposes, including a base body, and field emitting bodies extending from the base body, wherein:

said base body includes a longitudinally extending core having a central axis, the field emitting bodies are elongate and are distributed along at least a part of the length of the core, and the field emitting bodies extend radially outwards from the core and have free ends provided with field emitting surfaces.

13. The field emission cathode according to claim 12, wherein:

the core comprises a rod, the field emitting bodies are carbon fibers, and said carbon fibers are attached to annular discs.

14. The field emission cathode according to claim 13, wherein:

each fiber is attached at its center portion to the annular discs, each fiber exhibit two field emitting surfaces, one at each end.

15. The field emission cathode according to claim 12, wherein:

the core comprises a rod, the field emitting bodies are carbon fibers, and said carbon fibers are clamped between annular discs.

16. The field emission cathode according to claim 15, wherein:

each fiber is attached at its center portion to the annular discs, each fiber exhibit two field emitting surfaces, one at each end.

* * * * *